US011441565B2

(12) United States Patent
Park et al.

(10) Patent No.: US 11,441,565 B2
(45) Date of Patent: Sep. 13, 2022

(54) COMPRESSOR HAVING OLDHAM'S RING

(71) Applicant: LG Electronics Inc., Seoul (KR)

(72) Inventors: Sang Baek Park, Seoul (KR); Jungsun Choi, Seoul (KR); Cheol Hwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 363 days.

(21) Appl. No.: 16/409,138

(22) Filed: May 10, 2019

(65) Prior Publication Data

US 2019/0345942 A1 Nov. 14, 2019

(30) Foreign Application Priority Data

May 10, 2018 (KR) ..... 10-2018-0053899
May 10, 2018 (KR) ..... 10-2018-0053901

(51) Int. Cl.
*F04C 29/00* (2006.01)
*F01C 17/06* (2006.01)
*F04C 18/02* (2006.01)

(52) U.S. Cl.
CPC ..... *F04C 29/0071* (2013.01); *F01C 17/066* (2013.01); *F04C 18/0215* (2013.01); *F04C 29/0057* (2013.01); *F04C 2240/801* (2013.01)

(58) Field of Classification Search
CPC ..... F04C 29/0071; F04C 18/0215; F04C 2240/801; F04C 18/0269; F04C 18/0292;
(Continued)

(56) References Cited

U.S. PATENT DOCUMENTS 5,152,682 A * 10/1992 Morozumi ..... F04C 23/008 418/55.1
5,275,543 A * 1/1994 Tanaka ..... F16D 3/04 418/55.3

(Continued)

FOREIGN PATENT DOCUMENTS

JP H0587063 4/1993
JP 2012188976 10/2012

(Continued)

OTHER PUBLICATIONS

Extended European Search Report in European Application No. 19173192.6, dated Oct. 11, 2019, 7 pages.

(Continued)

*Primary Examiner* — Dominick L Plakkoottam
*Assistant Examiner* — Paul W Thiede
(74) *Attorney, Agent, or Firm* — Fish & Richardson P.C.

(57) ABSTRACT

A scroll compressor includes a drive motor, a rotary shaft coupled to the drive motor, a main frame disposed below the drive motor, a fixed scroll disposed below the main frame, an orbiting scroll disposed between the main frame and the fixed scroll and eccentrically coupled to the rotary shaft, and an Oldham's ring coupled to the main frame and the orbiting scroll and configured to restrict rotation of the orbiting scroll relative to the fixed scroll. The Oldham's ring includes: a ring body, a first key that receives a first fixing boss of the ring body and that is configured to couple to the main frame, and a second key that receives a second fixing boss of the ring body and that is configured to couple to the orbiting scroll.

13 Claims, 10 Drawing Sheets

(58) Field of Classification Search
CPC ... F04C 23/008; F04C 29/0057; F01C 17/066
See application file for complete search history.

(56) References Cited

U.S. PATENT DOCUMENTS

| | | | | |
|---|---|---|---|---|
| 6,106,252 | A * | 8/2000 | Yamanaka | F01C 17/066 418/55.3 |
| 7,014,438 | B2 * | 3/2006 | Fukuda | F01C 17/066 418/178 |
| 7,661,938 | B2 * | 2/2010 | Ginies | F04C 18/0215 418/179 |
| 8,241,022 | B2 * | 8/2012 | Nakajima | F04C 18/0253 418/55.3 |
| 10,400,770 | B2 * | 9/2019 | Fullenkamp | F01C 17/066 |
| 2009/0047161 | A1 | 2/2009 | Ginies et al. | |
| 2016/0053759 | A1 * | 2/2016 | Choi | F04C 18/0269 418/55.2 |
| 2017/0067466 | A1 | 3/2017 | Oh et al. | |
| 2017/0234313 | A1 * | 8/2017 | Fullenkamp | F04C 29/0071 418/55.3 |
| 2018/0073507 | A1 * | 3/2018 | Choi | F04C 18/0292 |
| 2020/0263544 | A1 * | 8/2020 | Park | F01C 17/066 |

FOREIGN PATENT DOCUMENTS

| | | |
|---|---|---|
| KR | 20160022146 | 2/2016 |
| KR | 20170029313 | 3/2017 |

OTHER PUBLICATIONS

Office Action in Korean Appln. No. 10-2018-0053899, dated May 18, 2022, 12 pages (with English translation).

* cited by examiner

COMPRESSOR HAVING OLDHAM'S RING

CROSS-REFERENCE TO RELATED APPLICATIONS

The present disclosure claims priority to and the benefit of Korean Patent Application No. 10-2018-0053899, filed on May 10, 2018, and Korean Patent Application No. 10-2018-0053901, filed on May 10, 2018, the disclosures of which are incorporated herein by reference in their entirety.

BACKGROUND

1. Field of the Invention

A compressor that has an Oldham's ring to prevent an orbiting scroll from rotating about a fixed scroll is disclosed herein.

2. Description of Related Art

Generally, a compressor may be operated in a vapor compression type refrigeration cycle (hereinafter; referred to as "a refrigeration cycle") used for a refrigerator or an air conditioner.

Compressors may be classified into reciprocating compressors, rotary compressors, and scroll compressors according to a manner of compressing refrigerant.

In the scroll compressor, an orbiting scroll may be engaged with a fixed scroll fixed to an inner space of an airtight container and performs an orbiting movement so that a compression chamber is formed between a fixed wrap of the fixed scroll and an orbiting wrap of the orbiting scroll.

The scroll compressor may be widely used for compressing the refrigerant in an air conditioner, and the like because the scroll compressor may obtain a relatively higher compression ratio than the other types of compressors and may obtain a stable torque because suction, compression, and discharge of the refrigerant are smoothly and sequentially performed.

The scroll compressor may be classified into upper compression type scroll compressors or lower compression type scroll compressors according to positions of a drive motor and a compression. In the upper compression type scroll compressor, the compression may be disposed at an upper side of the drive motor. In the lower compression type scroll compressor, the compressor may be disposed at a lower side of the drive motor.

The lower compression type scroll compressor may have an Oldham's ring as a rotation prevention mechanism so that the orbiting scroll performs the orbiting movement on the fixed scroll.

Specifically, the Oldham's ring may have a structure in which a key protrudes from a ring-shaped body, and some keys are radially slidably inserted into a key groove formed in the orbiting scroll, and the remaining keys are radially slidably inserted into a key groove formed in the main frame.

In order to reduce a weight and abrasion of the Oldham's ring, the Oldham's ring may be formed by press-fitting (i.e., combining or assembling) the body and the key which are made of different materials from each other.

However, in the case of the above-described Oldham's ring formed by the press-fitting method, the key may be detached from the body or distorted due to insufficient press-fitting force of the body and the key during the orbiting movement of the orbiting scroll. In addition, shape accuracy of the Oldham's ring is degraded because the key provided on the Oldham's ring is difficult to be processed to have a right angle to a thrust surface formed to protrude from a periphery of the key.

On the other hand, the Oldham's ring may be configured in such a manner that the body and the keys, which are separately formed respectively, are coupled (i.e., assembled) to each other.

However, when the key may be slidably inserted into a key groove, friction occurs between the key and the key groove when the orbiting scroll performs the orbiting movement on the fixed scroll, and stress is concentrated on a neck of the key. In addition, as the body and the key are separately formed, respectively, and are coupled to each other, there is a high possibility that stress is more concentrated on a neck of the key during the orbital movement of the orbiting scroll and the key may be damaged.

In addition, as the Oldham's ring is made of the same material as the orbiting scroll, abrasion of the Oldham's ring may be significantly caused by the contact with the orbiting scroll. Furthermore, a rotation preventing function of the orbiting scroll may be deteriorated due to abrasion of the Oldham's ring and reliability of the scroll compressor is degraded.

SUMMARY OF THE INVENTION

The present disclosure provides a scroll compressor capable of an orbiting movement of an orbiting scroll on a fixed scroll while preventing rotation of the orbiting scroll.

The present disclosure also provides a scroll compressor capable of preventing detachment and distortion of a key provided on an Oldham's ring.

The present disclosure further provides a scroll compressor in which shape accuracy of the Oldham's ring is improved.

The present disclosure also provides a scroll compressor capable of minimizing concentration of stress on a neck of a key provided on the Oldham's ring.

The present disclosure further provides a scroll compressor capable of minimizing abrasion that is caused due to contact with the orbiting scroll by having all or some of the Oldham's ring made of different material from that of the orbiting scroll.

The objects of the present disclosure are not limited to the above-mentioned objects, and other objects and advantages of the present disclosure which are not mentioned can be understood by the following description and more clearly understood by the embodiments of the present disclosure. It will also be readily apparent that the objects and the advantages of the present disclosure may be implemented by means defined in claims and a combination thereof.

According to the present disclosure, the scroll compressor includes the Oldham's ring that is coupled to a main frame and an orbiting scroll, respectively, thereby enabling the orbiting movement of the orbiting scroll on the fixed scroll while preventing the rotation of the orbiting scroll.

According to the present disclosure, the scroll compressor includes a body that has a ring shape, a first key that is inserted into a first fixing boss formed to protrude from one side of the body and is coupled to a main frame and a second key that is inserted into a second fixing boss formed to protrude from the other side of the body and is coupled to an orbiting scroll, and a thrust surface that is formed to be stepped relative to the body is provided at a lower portion of each of the first key and the second key, thereby preventing the key provided on the Oldham's ring from being detached from the body and being distorted.

Further, according to the present disclosure, the scroll compressor may include the Oldham's ring that includes the key formed in an integrated manner with the thrust surface, thereby improving the shape accuracy of the Oldham's ring.

Further, according to the present disclosure, the scroll compressor includes a body that has a ring shape, a first key that is formed to protrude from one side of the body and is coupled to the main frame, and a second key that is formed to protrude from the other side of the body and is coupled to the orbiting scroll, and the neck of each of the first and second keys is round-processed so that the concentration of stress on the neck of the key provided in the Oldham's ring may be minimized.

Further, according to the present disclosure, the scroll compressor may include the Oldham's ring that all or some of which are made of different materials from the orbiting scroll, thereby minimizing the abrasion of the Oldham's ring, which is caused by the contact with the orbiting scroll.

According to the present disclosure, the scroll compressor enables the orbiting movement of the orbiting scroll on the fixed scroll while preventing the rotation of the orbiting scroll so that compression efficiency of the scroll compressor may be improved.

In addition, according to the present disclosure, the scroll compressor may prevent the key provided in the Oldham's ring from being detached from the body and being distorted, thereby improving a binding force of the key with respect to the body. Further, the scroll compressor may enable the stable orbiting movement of the orbiting scroll by improving the binding force of the key with respect to the body.

In addition, according to the present disclosure, the scroll compressor improves the shape accuracy of the Oldham's ring, thereby providing a stable support point for preventing the key from being detached from the body, and being distorted. Further, reliability of the scroll compressor may be improved by providing the stable support point.

Further, according to the present disclosure, the scroll compressor may minimize the concentration of the stress on the neck of the key provided in the Oldham's ring, thereby improving durability and strength of the neck of the key. Furthermore, wear and damage of the key may be minimized by improving the durability and the strength of the neck of the key.

In addition, according to the present disclosure, the scroll compressor may suppress that the Oldham's ring is worn due to the contact with the orbiting scroll, thereby minimizing deterioration in the rotation preventing function of the orbiting scroll due to the damage of the Oldham's ring. Further, the deterioration in the rotation preventing function of the orbiting scroll may be minimized so that the deterioration in the reliability of the scroll compressor may be minimized.

A specific effect of the present disclosure, in addition to the above-mentioned effect, will be described together while describing a specific matter for implementing the present disclosure.

DETAILED DESCRIPTION OF EXEMPLARY EMBODIMENTS

Figure 1:
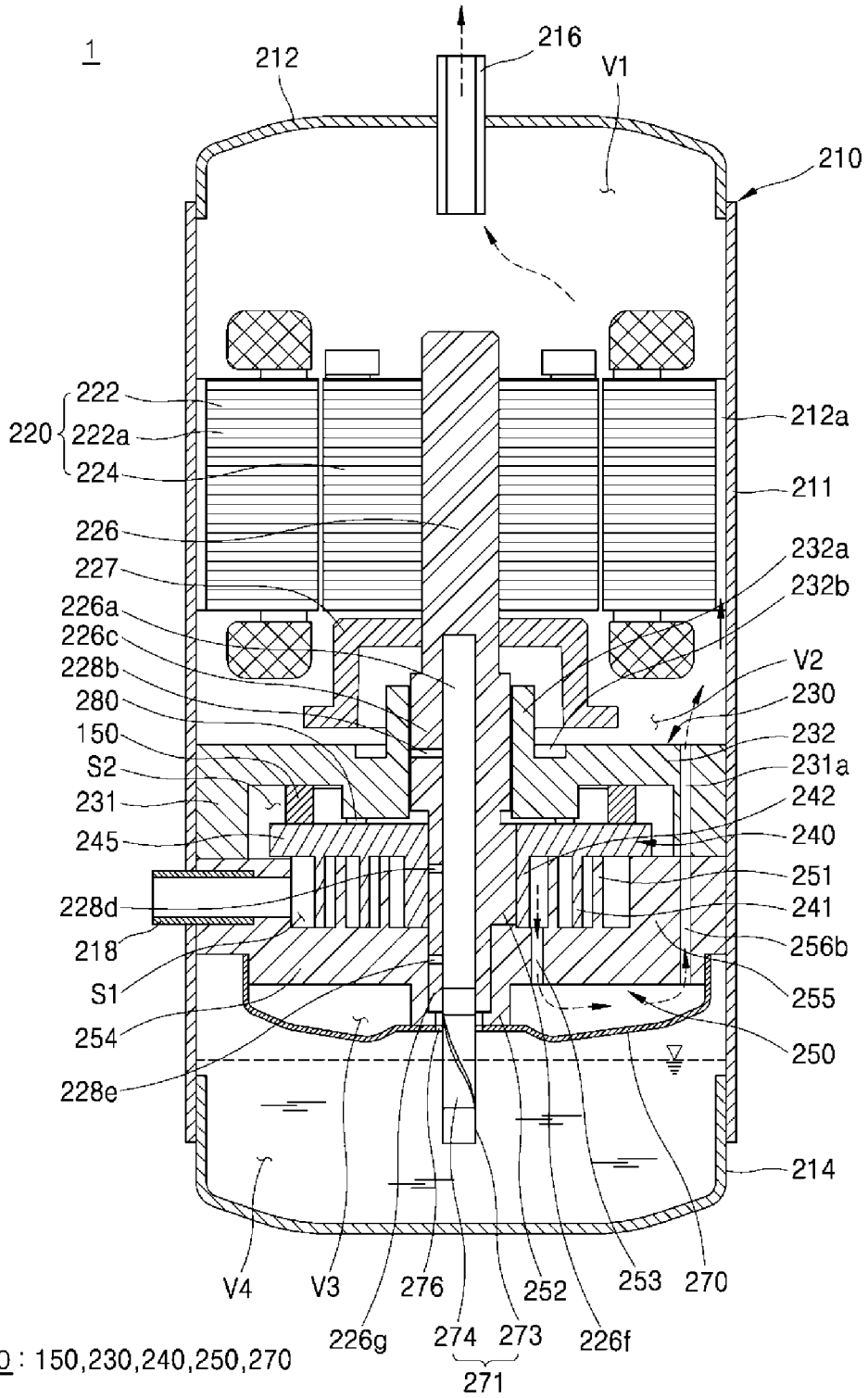
FIG. 1 is a cross-sectional view of a scroll compressor according to an embodiment of the present disclosure.

Hereinafter, preferred embodiments of the present disclosure will be described in detail with reference to the accompanying drawings. In the drawings, the same reference numerals are used to indicate the same or similar elements.

Hereinafter, according to an embodiment of the present disclosure, a scroll compressor will be described with reference to FIG. 1.

FIG. 1 is a cross-sectional view of a scroll compressor according to an embodiment of the present disclosure.

According to the embodiment of the present disclosure, the scroll compressor 1 includes a casing 210 that has an inner space, a drive motor 220 that is provided at an upper portion of the inner space, a compressor 200 that is arranged at a lower portion of the drive motor 220, and a rotary shaft 226 that transmits drive force of the drive motor 220 to the compressor 200.

The inner space of the casing 210 may be divided into a first space V1, which may be provided at an upper side of the drive motor 220, a second space V2 between the drive motor 220 and the compressor 200, a third space V3 partitioned by a discharge cover 270, an oil storage space V4 which may be provided at lower side of the compressor 200.

The casing 210 may, for example, have a cylindrical form, so that the casing 210 may include a cylindrical shell 211.

Further, an upper shell 212 may be installed on an upper portion of the cylindrical shell 211 and a lower shell 214 may be installed on a lower portion of the cylindrical shell 211. The upper and lower shells 212 and 214 may be coupled to the cylindrical shell 211 by welding, for example, to form the inner space of the casing 210.

A refrigerant discharge pipe 216 may be installed in the upper shell 212, through which compressed refrigerant discharged into the second space V2 and the first space V1 from the compressor 200 is discharged into an outside of the casing.

For reference, an oil separator (not shown) may be connected to the refrigerant discharge pipe 216 to separate the oil mixed with the refrigerant discharged into the second space V2 and the first space V1 from the refrigerant discharged into the second space V2 and the first space V1.

The lower shell 214 may form an oil storage space V4 capable of storing oil.

The oil storage space V4 may function as an oil chamber to supply oil to the compressor 200 so that the compressor is smoothly operated.

Further, a refrigerant suction pipe 218, which may form a path through which the refrigerant to be compressed flows, may be installed at a side of the cylindrical shell 211.

The refrigerant suction pipe 218 may be installed through the side of the fixed scroll 250 to a compression chamber S1 along a side of the fixed scroll 250.

A drive motor 220 may be installed on an upper portion in the inside of the casing 210.

Specifically, the drive motor 220 may include a stator 222 and a rotor 224.

The stator 222 may have a cylindrical shape, for example, and may be fixed to the casing 210. The stator 222 has a plurality of slots (not shown) formed along a circumferential direction of the stator 222 on an inner circumferential surface of the stator 222 so that the coil 222*a* is wound around a plurality of slots. Further, a refrigerant flow path groove 212*a* may be formed in the outer circumferential surface of the stator 222 so as to be cut into a D-cut shape to allow the refrigerant or the oil discharged from the compressor 200 to pass through the refrigerant flow path groove 212*a*.

The rotor 224 may be coupled to an inside of the stator 222 and may generate rotational power. A rotary shaft 226 may be rotated together with the rotor 224 by press-fitting the rotary shaft 226 into a center of the rotor 224. The rotational power generated by the rotor 224 is transmitted to the compressor 200 through the rotary shaft 226.

The compressor 200 may include an Oldham's ring 150 (any one of components 150-1, 150-2, and 150-3 described below), a main frame 230, a fixed scroll 250, an orbiting scroll 240, and a discharge cover 270.

The Oldham's ring 150 may be installed between the main frame 230 and the orbiting scroll 240. In addition, the Oldham's ring 150 may be coupled, to the main frame 230 and the orbiting scroll 240, respectively, to prevent the orbiting scroll 240 from rotating. The details thereof will be described below.

The main frame 230 may be provided at a lower portion of the drive motor 220 and may form an upper portion of the compressor 200.

The main frame 230 may include a frame end plate 232 (hereinafter; referred to as "a first end plate") that has a substantially circular shape and a frame bearing section 232*a* (hereinafter; referred to as "a first bearing section") that is provided at a center of the first end plate 232 and through which the rotary shaft 226 passes, and a frame side wall 231 (hereinafter; referred to as "a first side wall") protruding downward from an outer circumference of the first end plate 232.

An outer circumference of the first side wall 231 contacts an inner circumferential surface of the cylindrical shell 211 and the lower end of the first side wall 231 contacts the upper end of the fixed scroll side wall 255 described below.

The first side wall 231 may be provided with a frame discharge hole (hereinafter; referred to as "a first discharge hole") 231*a* which passes through the inside of the first side wall 231 axially and defines a refrigerant path. An inlet of the first discharge hole 231*a* may be connected to an outlet of the fixed scroll discharge hole 256*b* to be described below, and the outlet of the first discharge hole 231*a* may be connected to the second space V2.

The first bearing section 232*a* may protrude from the upper surface of the first end plate 232 adjacent to the drive motor 220. Further, the first bearing may be formed on the first bearing section 232*a* so that the main bearing 226*c* of the rotary shaft 226, described below, passes through.

That is, the first bearing 232*a* in which the main bearing 226*c* of the rotary shaft 226 the first bearing includes is rotatably inserted into the first bearing 232*a* and is supported by the first bearing section 232*a* may penetrate through the center of the main frame 230 axially.

An oil pocket 232*b* that collects the oil discharged between the first bearing section 232*a* and the rotary shaft 226 may be formed on the upper surface of the first end plate 232.

Specifically, the oil pocket 232*b* may be engraved on the upper surface of the first end plate 232, and may have an annular shape along the outer circumferential surface of the first bearing 232*a*.

A first key groove (not shown) into which the first key 154 of the Oldham's ring 150 is inserted may be formed over the first end plate 232 and the first side wall 231, the details thereof will be described below.

A space may be formed in a bottom surface of the main frame 230 together with the fixed scroll 250 and the orbiting scroll 240 so that a back pressure chamber S2 may be formed to support the orbiting scroll 240 by the pressure of the space.

For reference, the back pressure chamber S2 may be an intermediate-pressure area (that is, an intermediate-pressure chamber) and an oil supply flow path 226*a* provided in the rotary shaft 226 may have high pressure greater than the pressure of the back pressure chamber S2. Further, a space surrounded by the rotary shaft 226, the main frame 230, and the orbiting scroll 240 may be a high pressure area (for example, S3 of FIG. 3)

A back pressure seal 280 may be provided between the main frame 230 and the orbiting scroll 240 to distinguish the high-pressure area (for example, S3 in FIG. 3) from the intermediate-pressure area S2. The back pressure seal 280 may serve, for example, as a sealing member.

In addition, the main frame 230 may be coupled to the fixed scroll 250 to form a space in which the orbiting scroll 240 may be installed to orbit. That is, this structure to cover the rotary shaft 226 may enable the rotating power to be transmitted to the compressor 200 through the rotary shaft 226.

The fixed scroll 250 corresponding to the first scroll may be coupled to the bottom of the main frame 230.

Specifically, the fixed scroll 250 may be provided under the main frame 230.

Further, the fixed scroll 250 may have a fixed scroll end plate (a second end plate) 254 that has a substantially circular shape, a fixed scroll side wall 254 (hereinafter; referred to as "a second side wall") protruding upward from an outer circumference of the second end plate 254, a fixed wrap 251 that protrudes from the upper surface of the second end plate 254 and is engaged with the orbiting wrap 241 of the orbiting scroll 240 described below to form a compression chamber S1, and a fixed scroll bearing section (hereinafter; referred to as "a second bearing section") 252 formed at the center of a rear surface of the second end plate 254 and through which the rotary shaft 226 passes.

A discharge path 253 to guide the compressed refrigerant into an inner space of the discharge cover 270 from the compression chamber S1 may be formed in the second end plate 254. Further, a position of the discharge path 253 may be arbitrarily set in consideration of required discharge pressure, and the like.

As the discharge path 253 is formed toward the lower shell 214, a discharge cover 270 may be coupled to the bottom surface of the fixed scroll 250 to accommodate the discharged refrigerant and guide the refrigerant into a fixed scroll discharge hole 256*b* described below so as not to be mixed with the oil. The discharge cover 270 may be coupled to the bottom surface of the fixed scroll 250 in a sealed manner to separate the discharge flow path of the refrigerant from the oil storage space V4.

Further, a through-hole 276 may be formed in the discharge cover 270 so that an oil feeder 271 is coupled to a sub-bearing 226*b* of the rotary shaft 226 the second bearing includes and is submerged in an oil storage space V4 of the casing 210.

Meanwhile, the outer circumference of the second side wall 255 contacts the inner circumferential surface of the cylindrical shell 211 and the upper end of the second side wall 255 contacts the lower end of the first side wall 231.

Further, the second side wall 255 may have a fixed scroll discharge hole 256*b* (hereinafter; referred to as "a second discharge hole") that passes through the inside of the second side wall 255 axially and defines a refrigerant path together with the first discharge hole 231*a*.

The second discharge hole 256*b* may be formed to correspond to the first discharge hole 231*a* and the inlet of the second discharge hole 256*b* may be connected to the inner space of the discharge cover 270 and the outlet of the second discharge hole 256*b* may be connected to the inlet of the first discharge hole 231*a*.

The second discharge hole 256*b* and the first discharge hole 231*a* may connect the third space V3 and the second space V2 so that the refrigerant discharged into the inner space of the discharge cover 270 from the compression chamber S1 is guided to the second space V2.

A refrigerant suction pipe 218 may be installed in a second side wall 255 so that the refrigerant suction pipe 218 is connected to a suction part of the compression chamber S1. Further, the refrigerant suction pipe 218 may be installed to be spaced apart from the second discharge hole 256*b*.

The second bearing section 252 may protrude from the lower surface of the second end plate 254 adjacent to the oil storage space V4.

The second bearing section 252 may be provided such that a sub-bearing 226*g* of the rotary shaft 226, described below, is inserted into the second bearing section 252 and supported on the second bearing section 252.

The lower end of the second bearing section 252 may be bent toward a center of the rotary shaft to support the lower end of the sub-bearing 226*g* of the rotary shaft 226 to form a thrust bearing surface.

The orbiting scroll 240 corresponding to the second scroll may be installed between the main frame 230 and the fixed scroll 250.

Specifically, the orbiting scroll 240 is coupled to the rotary shaft 226 and performs the orbiting movement, and a pair of compression chambers S1 may be formed between the fixed scroll 250 and the orbiting scroll 240, respectively.

Further, the orbiting scroll 240 may include an orbiting scroll end plate (hereinafter; referred to as "a third end plate") 245 that has a substantially circular shape, a orbiting wrap 254 protruding from a lower surface of the third end plate 245 and engaged with the fixed wrap 251, and a rotary shaft coupler 242 provided at a center of the third end plate 245 and rotatably coupled to an eccentric portion 226*f* of the rotary shaft 226 described below.

The outer circumference of the third end plate 245 is disposed at the upper end of the second side wall 255 and the lower end of the orbiting wrap 241 is closely attached to the upper surface of the second end plate 254, so that the orbiting scroll 240 may be supported by the fixed scroll 250.

For reference, a second key groove (not shown) may be formed at the outer circumference of the third end plate 245, that is, at the outer circumference of the upper surface of the third end plate 245, into which the second key 156 of the Oldham's ring 150 is inserted. The details thereof will be described below.

The outer circumference of the rotary shaft coupler 242 is connected to the orbiting wrap 241 so as to form the compression chamber S1 together with the fixed wrap 251 during the compression of the scroll compressor.

For reference, the fixed wrap 251 and the orbiting wrap 241 may have an involute shape, but may have various types of shapes.

The involute shape means a curved line corresponding to a trajectory drawn by an end of thread when the thread wound around a base circle that has an arbitrary radius is released.

Further, an eccentric portion 226*f* of the rotary shaft 226 may be inserted into the rotary shaft coupler 242. The eccentric portion 226*f* inserted into the rotary shaft coupler 242 may be overlapped with the orbiting wrap 241 or the fixed wrap 251 in the radial direction of the compressor.

The radial direction of the compressor may mean a direction orthogonal to the axial direction of the compressor (i.e., a vertical direction of the compressor) (that is, a lateral direction of the compressor), and more specifically, the radial direction of the compressor may mean a direction toward the inside of the rotary shaft from the outside of the rotary shaft.

As described above, when the eccentric portion 226*f* of the rotary shaft 226 is radially overlapped with the orbiting wrap 241 through the end plate 245 of the orbiting scroll 240, repulsive force and compressive force of the refrigerant are applied to the same plane based on the end plate 245 so that a part of the repulsive power and the compressive force of the refrigerant may be offset against each other.

The rotary shaft 226 may be coupled to the drive motor 220 and may have an oil supply flow path 26*a* to guide the oil contained in the oil storage space V4 of the casing 210 to the upper portion of the casing 210.

Specifically, the upper portion of the rotary shaft 226 is press-fitted into the center of the rotor 224, and the lower portion of the rotary shaft 226 may be coupled to the compressor 200 and may be supported radially.

Accordingly, the rotary shaft 226 may transmit the rotational force of the drive motor 220 to the orbiting scroll 240 of the compressor 200. In addition, the orbiting scroll 240 eccentrically coupled to the rotary shaft 226 performs the orbiting movement with respect to the fixed scroll 250.

A main bearing 226*c* may be formed on the lower portion of the rotary shaft 226 to be inserted into the first bearing section 232*a* of the main frame 230 and radially supported by the first bearing 232*a* of the main frame 230. Further, a sub-bearing 226*g* may be formed at the lower portion of the main bearing 226*c* to be inserted into the second bearing section 252 of the fixed scroll 250 and radially supported by the second bearing 252 of the fixed scroll 250.

The eccentric portion 226*f* may be formed between the main bearing 226*c* and the sub-bearing 226*g* to be inserted into and coupled to the rotary shaft coupler 242 of the orbiting scroll 240.

The main bearing 226*c* and the sub-bearing 226*g* may be formed on the coaxial line so as to have the same axial center. On the other hand, the eccentric portion 226*f* may be formed eccentrically in the radial direction of the scroll compressor with respect to the main bearing 226*c* or the sub-bearing 226*g*.

For reference, the eccentric portion 226*f* may have an outer diameter less than the outer diameter of the main bearing 226*c* and greater than an outer diameter of the sub-bearing 226*g*. In this case, it may be advantageous to couple the rotary shaft 226 to the respective bearings 232*a*, 252 and the rotary shaft coupler 242 through the respective bearing sections 232*a*, 252 and the rotary shaft coupler 242.

On the other hand, the eccentric portion 226*f* may not be formed in an integrated manner with the rotary shaft 226 but may be formed using a separate bearing. In this case, the outer diameter of the sub-bearing 226*g* may not be formed to be less than the outer diameter of the eccentric portion 226*f*, but the rotary shaft 226 may be inserted into and coupled to the respective bearing sections 232*a*, 252 and the rotary shaft coupler 242.

An oil supply flow path 226*a* to supply the oil in the oil storage space V4 to the outer circumferential surfaces of the bearings 226*c* and 226*g* and the outer circumferential surface of the eccentric portion 226*f* may be formed in the rotary shaft 226. Oil holes 228*b*, 228*d*, and 228*e* may be formed in the bearing and the eccentric portions 226*c*, 226*g*, and 226*f* of the rotary shaft 226 so as to pass through a space between the oil supply flow path 226*a* and the outer circumferential surfaces of the eccentric portions 226*c*, 226*g*, and 226*f*, respectively.

For reference, the oil guided upward through the oil supply flow path 226*a* may be discharged through the oil holes 228*b*, 228*d*, and 228*e* and may be supplied to the bearing surface, and the like.

The oil feeder 271 that pumps the oil contained in the oil storage space V4 may be coupled to the lower end of the rotary shaft 226, that is, the lower end of the sub-bearing 226*g*.

The oil feeder 271 may include an oil supply pipe 273 inserted into and coupled to the oil supply flow path 226*a* of the rotary shaft 226 and an oil suction member 274 that is inserted into the inside of the oil supply pipe 273 and suctions the oil.

The oil supply pipe 273 may be installed so as to pass through the through hole 276 of the discharge cover 270 to be submerged in the oil storage space V4, and the oil suction member 274 may function as a propeller.

Although not shown in the drawings, a trochoid pump (not shown) may be coupled to the sub-bearing 226*g* to force the oil contained in the oil storage space V4 upward, instead of the oil feeder 271.

Further, although not shown in the drawings, according to the embodiment of the present disclosure, the scroll compressor may further include a first sealing member (not shown) to seal a gap between an upper end of the main bearing 226*c* and an upper end of the main frame 230, and a second sealing member (not shown) to seal the gap between the lower end of the sub-bearing 226*g* and the lower end of the fixed scroll 250.

For reference, it is possible to prevent the oil from flowing into the outside of the compressor 200 along the bearing surface through the first and second sealing members, thereby having a differential pressure oil supply structure and preventing reverse flow of the refrigerant.

A balance weight 227 to suppress noise and vibration may be coupled to the rotor 224 or the rotary shaft 226.

For reference, the balance weight 227 may be provided between the drive motor 220 and the compressor 200, that is, in the second space V2.

According to the embodiment of the present disclosure, an operation of the scroll compressor 1 is as follows.

When a power is applied to the drive motor 220 to generate a rotating force, the rotary shaft 226 coupled to the rotor 224 of the drive motor 220 rotates. The orbiting scroll 240 eccentrically coupled to the rotary shaft 226 performs the orbiting movement with respect to the fixed scroll 250 to form the compression chamber S1 between the orbiting wrap 241 and the fixed wrap 251. The compression chamber S1 may be formed in several steps in succession as the volume of the compression chamber S1 gradually decreases toward the center direction of the rotary shaft.

The refrigerant supplied from the outside of the casing 210 through the refrigerant suction pipe 218 may be directly introduced into the compression chamber S1. The refrigerant may be compressed as the refrigerant moves in a direction of the discharge chamber of the compression chamber S1 by the orbiting movement of the orbiting scroll 240 and may be discharged into the third space V3 through the discharge path 253 of the fixed scroll 250 from the discharge chamber.

Thereafter, the compressed refrigerant discharged into the third space V3 repeats a series of processes in which the compressed refrigerant is discharged into the inner space of the casing 210 through the second discharge hole 256*b* and the first discharge hole 231*a* and is discharged into the outside of the casing 210 through the refrigerant discharge pipe 216.

Hereinafter, an example of the Oldham's ring shown in FIG. 1 will be described with reference to FIGS. 2 to 5.

Figure 2:
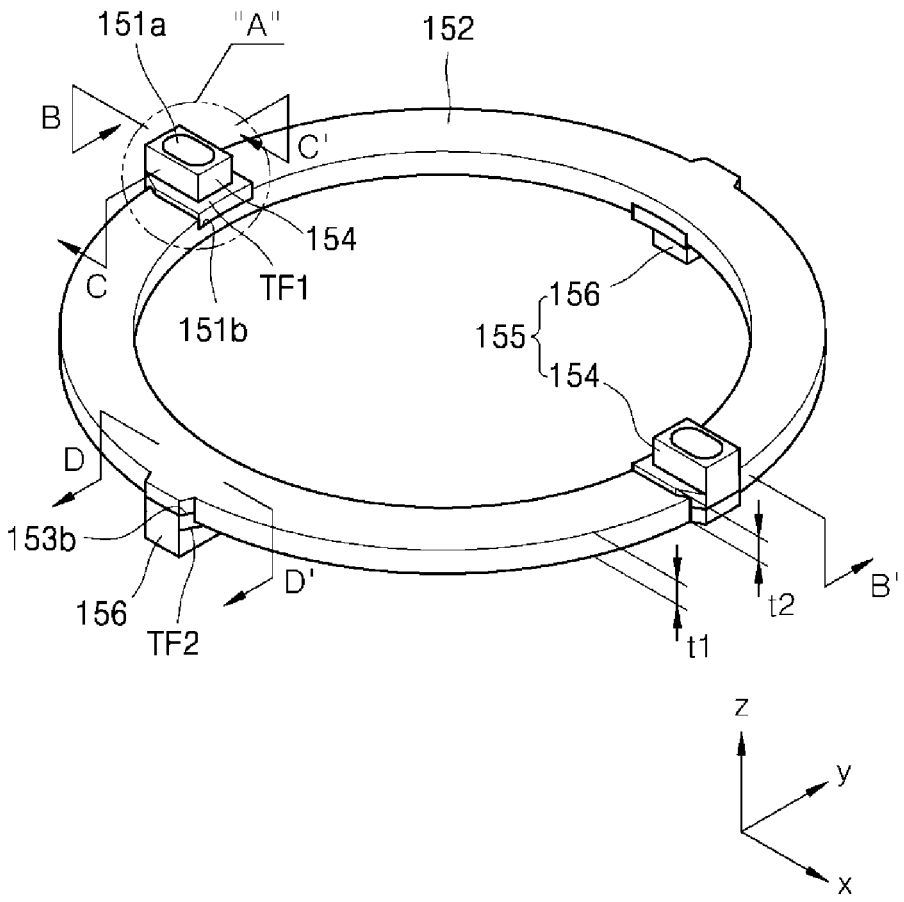
FIG. 2 is a perspective view of an example of the Oldham's ring of FIG. 1.
Figure 3:
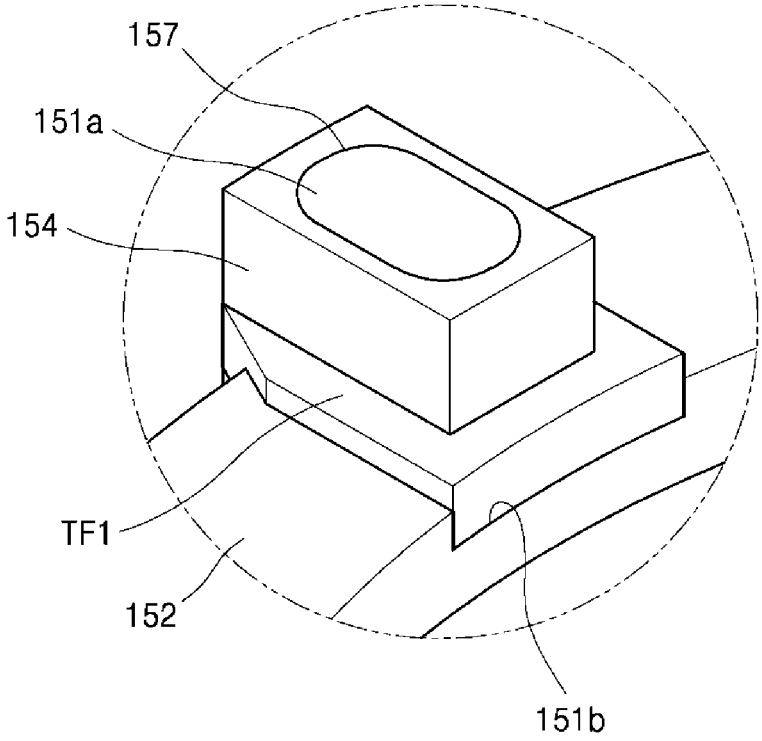
FIG. 3 is an enlarged view of portion A of FIG. 2.
Figure 4:
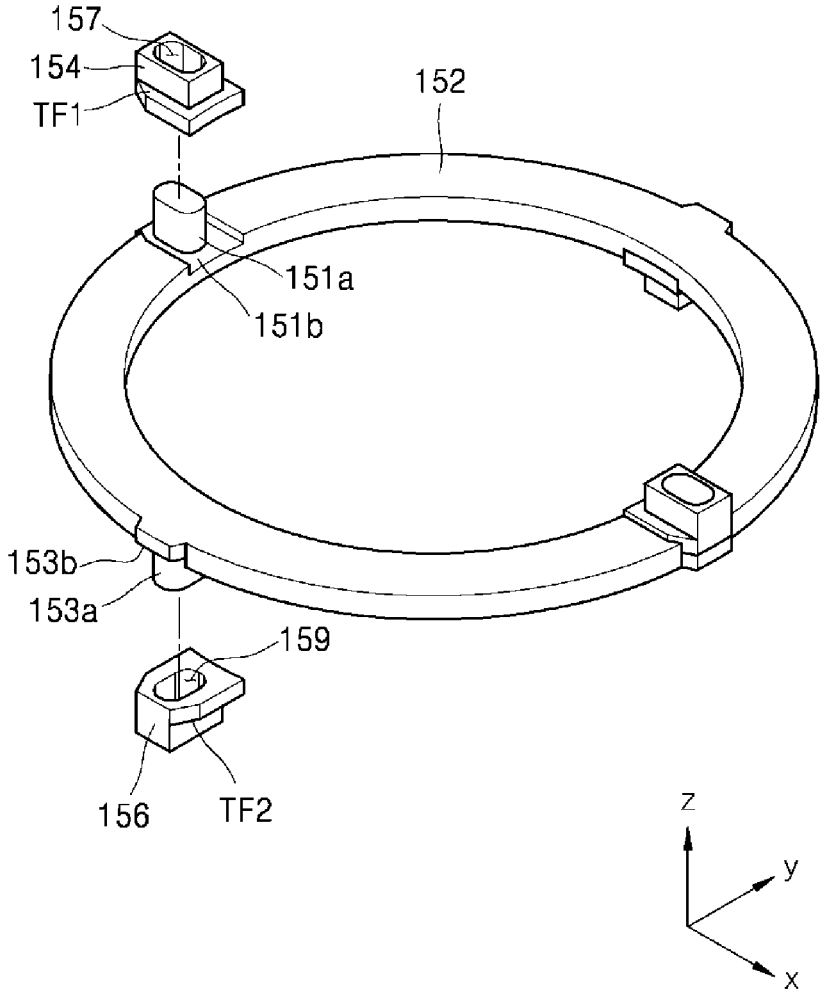
FIG. 4 is a partially exploded perspective view of the Oldham's ring of FIG. 2.
Figure 5:
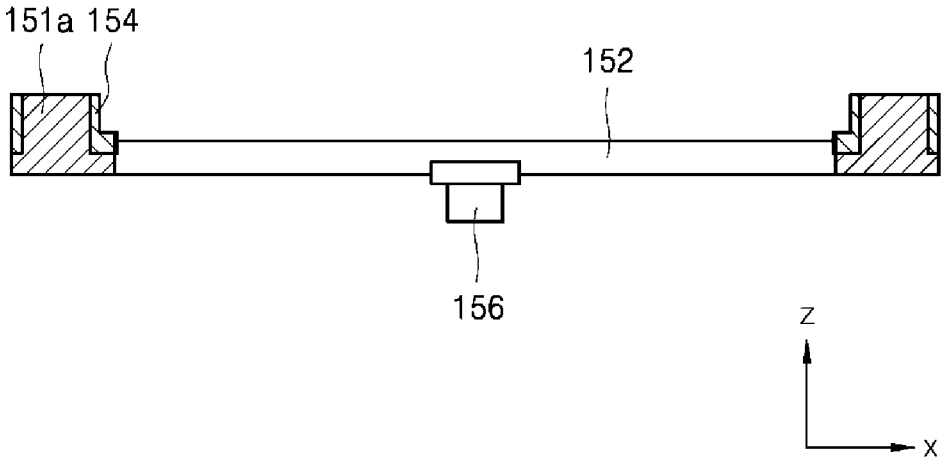
FIG. 5 is a cross-sectional view of the Oldham's ring taken along line B-B' of FIG. 2.

FIG. 2 is a perspective view of an example of the Oldham's ring of FIG. 1. FIG. 3 is an enlarged view of portion A in FIG. 2. FIG. 4 is a partially exploded perspective view of the Oldham's ring of FIG. 2. FIG. 5 is a cross-sectional view of the Oldham's ring taken along line B-B' of FIG. 2.

Specifically, referring to FIGS. 1 to 5, the Oldham's ring 150-1 may include a body 152 that has a ring shape, a first key 154 that is inserted into a first fixing boss 151*a* formed to protrude from one side of the body 152 and is coupled to the main frame 230, and a second key 156 that is inserted into a second fixing boss 153*a* formed to protrude from the other side of the body 152 and is coupled to the orbiting scroll 240.

The body 152 has a ring shape and both sides of the body 152, except for the first and second keys 155: 154 and 156, may have a flat shape in an axial direction (that is, a z-axis direction z; for reference, an x-axis direction x, a y-axis direction y, and a z-axis direction z are orthogonal to one another).

Of course, a key coupler (for example, 151*b* and 153*b*) formed concavely in the axial direction thereof by a predetermined depth may be formed at one side or the other side of the body 152.

Specifically, the first key coupler 151*b* may be formed concavely in the axial direction by a predetermined depth at a portion of one axial side of the body 152 where the first key 154 is to be coupled. In addition, a first fixing boss 151*a* that has a predetermined height may protrude axially from the first key coupler 151*b*.

A first thrust surface TF1 formed to be stepped with respect to one side of the body 152 is provided at a lower portion of the first key 154 in an integrated manner with the first key 154 and the first coupler 151*b* may be formed concavely in the axial direction thereof to correspond to a shape of the first thrust surface TF1.

Further, the second key coupler 153*b* may be formed concavely in the axial direction thereof by a predetermined depth at a portion of the other axial side where the second key 156 is to be coupled. Further, the second fixing boss 153*a* that has the predetermined height may be formed on the second key coupler 153*b* so as to protrude axially.

A second thrust surface TF2 formed to be stepped with respect to the other side of the body 152 is provided at a lower portion of the second key 156 in an integrated manner with the second key 156. The second key coupler 153*b* may be concavely formed axially to correspond to a shape of the second thrust surface TF2.

For reference, t1 is a thickness of the body 152 and t2 is a thickness between the other side of the body 152 and the first thrust surface TF1 (that is, a thickness between one side of the body 152 and the second thrust surface TF2), and t2 is greater than t1.

On the other hand, the first key 154 include a pair of keys, and the keys may be disposed at opposite sides to each other. Further, the second keys 156 also includes a pair of keys, and the keys may be disposed at opposite sides to each other.

For reference, the first key 154 may be arranged in a direction that intersects with the second key 156.

That is, the first keys 154 may be formed at one axial side of the body 152 at an interval of 180 degrees along the circumferential direction of the body 152, and the two second keys 156 may be formed at the other axial side of the body 152 with an interval of 180 degrees along the circumferential direction of the body 152.

Accordingly, the first key 154 and the second key 156 are alternately formed at an interval of 90 degrees along the circumferential direction of the body 152 when view from the top.

Further, the first and second keys 154 and 156 may be formed in a separate form from the body 152 and may be coupled to the body 152, respectively.

Specifically, a first fixing groove 157 into which the first fixing boss 151*a* is inserted may be formed in the first key 154. That is, the first fixing groove 157 may be formed to pass through the first key 154 axially and the first fixing boss 151*a* may be inserted into the first fixing groove 157.

The first fixing boss 151*a* may be press-fitted into the first fixing groove 157 or inserted into the first fixing groove 157 and may be welded or bonded with an adhesive. In this case, a cross-section of the first fixing boss 151*a* and the first fixing groove 157 may have, for example, an elliptical shape, a rectangular shape, or an angular shape so that the first key 154 does not rotate incorrectly.

Of course, the second fixing groove 159 into which the second fixing boss 153*a* is inserted may also be formed in the second key 156. That is, the second fixing groove 159 may be axially formed to pass through the second key 156, and the second fixing boss 153*a* may be inserted into the second fixing groove 159.

The second fixing boss 153*a* may be press-fitted into or inserted into the second fixing groove 159 and then welded or bonded with the adhesive. In this case, a cross-section of the second fixing boss 153*a* and the second fixing groove 159 may have for example, an elliptical shape, a rectangle shape, or an angular shape so that the second key 156 does not rotate incorrectly.

Meanwhile, the first key 154 may be inserted into a first key groove (not shown) formed in the main frame 230. That is, the main frame 230 may be formed with a first key groove into which the first key 154 is slidably inserted in the radial direction thereof, and the first key groove may be formed over, for example, a first end plate 232 and a first side wall 231, but is not limited thereto.

The second key 156 may be inserted into a second key groove (not shown) formed in the orbiting scroll 240. That is, the orbiting scroll 240 may be formed with a second key groove into which the second key 156 is radially slidably inserted, and the second key groove may be formed at the outer circumference of the third end plate 245, but is not limited thereto.

Through this configuration, when the first key 154 is inserted into the first key groove formed in the main frame 230 and the second key 156 is inserted into the second key groove formed in the orbiting scroll 240, the Oldham's ring 150-1 is arranged between the orbiting scroll 240 and the main frame 230 so as to be slidable laterally.

Meanwhile, as described above, the first thrust surface TF1 is provided at a lower portion of the first key 154 in an integrated manner with the first key 154 and the first thrust surface TF1 may be formed to be stepped with respect to one side of the body 152. A second thrust surface TF2 may be provided at a lower portion of the second key 156 in an integrated manner with the second key 156 and the second thrust surface TF2 may be formed to be stepped with respect to the other side of the body 152.

For reference, the first thrust surface TF1 may be provided in an integrated manner with the first key 154, thereby providing perpendicularity with respect to the first key 154. That is, the first thrust surface TF1 may be orthogonal to the side of the first key 154.

Further, the second thrust surface TF2 may be provided in an integrated manner with the second key 156, thereby providing perpendicularity with respect to the second key 156. That is, the second thrust surface TF2 may be orthogonal to the side of the second key 156.

As described above, as the first and second thrust surfaces TF1 and TF2 may have perpendicularity to the first and second keys 154 and 156, respectively, a stable support point may be provided to prevent the detachment and the distortion of the key, which is generated when the scroll compressor 1 is driven (that is, when the orbiting scroll 240 performs the orbiting movement).

Further, a detachment moment or a turnover moment generated when the scroll compressor 1 is driven may enable preventing the detachment of the key and the distortion of the key. Hereinafter, a principle of preventing the key from being detached from the body and distorted is described with reference to FIGS. 6 and 7.

Figure 6:
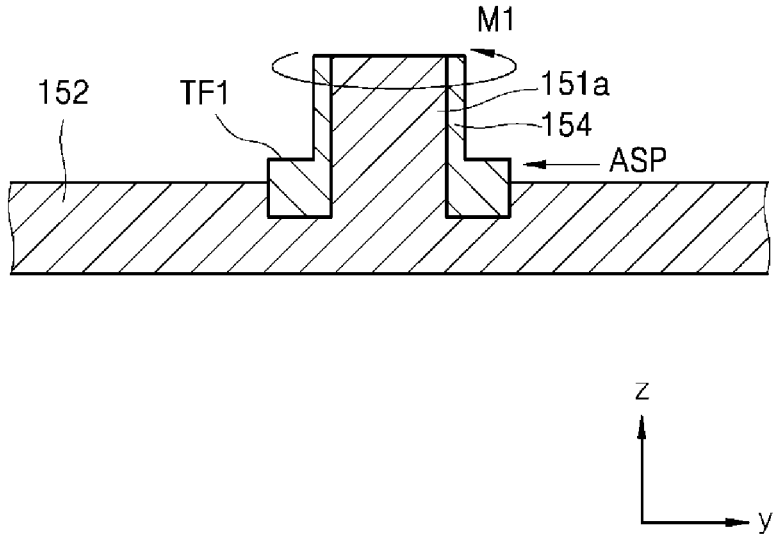
FIG. 6 is a cross-sectional view of the Oldham's ring taken along line C-C' of FIG. 2.
Figure 7:
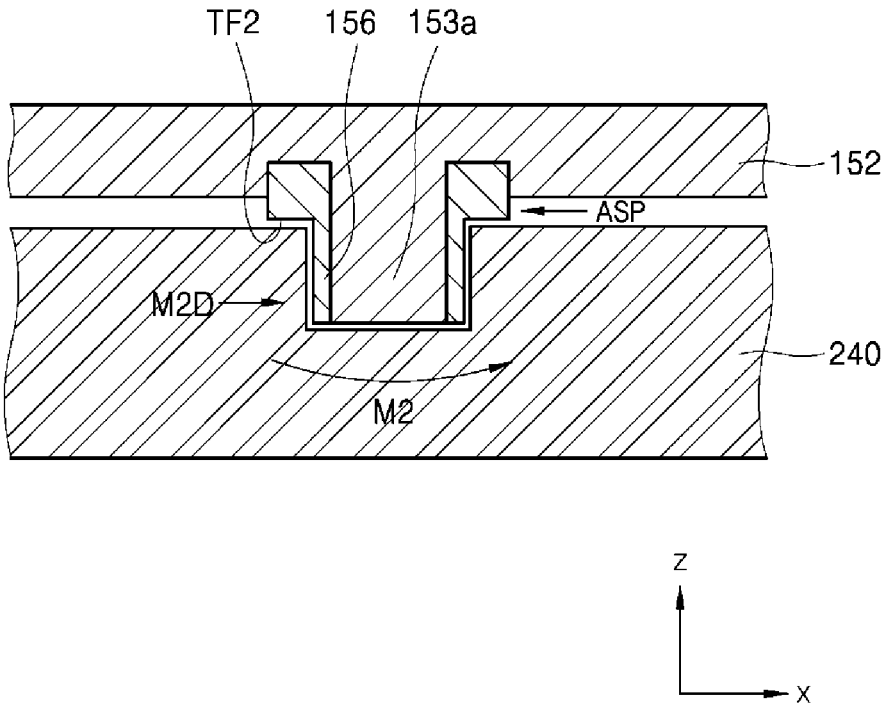
FIG. 7 is a cross-sectional view of the Oldham's ring taken along line D-D' of FIG. 2.

FIG. 6 is a cross-sectional view of the Oldham's ring taken along line C-C' of FIG. 2. FIG. 7 is a cross-sectional view of the Oldham's ring taken along line D-D' of FIG. 2.

For reference, FIG. 6 is a cross-sectional view of a first key 154, and FIG. 7 is a cross-sectional view of a second key 156. However, for convenience of explanation, an orbiting scroll 240 is further described in FIG. 7.

First, referring to FIGS. 1, 2 and 6, a detachment moment M1 that occurs during an orbiting movement of the orbiting scroll is shown.

Specifically, the detachment moment M1 may occur in a direction of θ of a z-axis direction (z) (that is, a direction of rotating about the z-axis) due to the orbiting movement of the orbiting scroll 240 and the first key 154 may be detached from the body or distorted by the detachment moment M1.

However, in the embodiment of the present disclosure, as a first thrust surface TF1 is provided at a lower portion of the first key 154, an additional support point ASP for the detachment moment M1 may be provided.

Accordingly, it is possible to prevent the first key 154 from being detached from the body or being distorted by the detachment moment M1.

Of course, although not shown in the drawings, the detachment or the distortion of the second key 156 may be prevented on the same principle as the above-described principle with respect to the detachment moment acting on the second key 156.

Next, referring to FIGS. 1, 2 and 7, a turnover moment M2 generated by swing of the orbiting scroll 240 is shown.

Specifically, the orbiting scroll 240 is shaken (that is, rattled) by gas force generated when the scroll compressor 1 is driven, and the turnover moment M2 may occur by the swing of the orbiting scroll 240.

Further, as shown in FIG. 7, the turnover moment M2 may occur in a direction M2D of rotating about the y-axis, or may also occur in a direction of rotating about the x-axis orthogonal to the y-axis.

When the turnover moment M2 generated by the above-described principle is transmitted to the second key 156, the force acts on the second key 156 in the direction of the turnover moment M2D and the second key 156 may be detached from the body or be distorted by the force acting in the direction of the turnover moment M2D.

However, in the embodiment of the present disclosure, as the second thrust surface TF2 is provided at a lower portion of the second key 156, an additional support point ASP for the turnover moment M2 may be provided.

Accordingly, it is possible to prevent the second key 156 from being detached from the body or being distorted by the turnover moment M2.

Of course, although not shown in the drawings, the turnover moment M2 may also be transmitted to the first key 154. However, with respect to the turnover moment M2 transmitted to the first key 154, the detachment or the distortion of the first key 154 may be prevented on the same principle as the above-described principle.

For reference, in an embodiment of the present disclosure, the body 152 may be made of the same material (e.g., aluminum) as the orbiting scroll 240, and the first and second keys 154 and 155 to which load is substantially applied by the main frame 230 and the orbiting scroll 240 may only be made of different materials, for example, cast iron or iron sintered alloy, and the like.

That is, materials of the entire components of the Oldham's ring 150-1 are not made of material different from that of the orbiting scroll 240, but only the first and second keys 154 and 155 are made of materials different from those of the orbiting scroll 240, to thereby minimize an increase in the weight of the Oldham's ring 150-1 due to the configuration of two types of materials and to reduce a degree of abrasion of the first and second keys 154 and 155 compared to a case where the first and second keys 154 and 155 are made of the same material as the orbiting scroll 240.

In addition, in the embodiment of the present disclosure, as the Oldham's ring has the keys that are formed on both sides of the body 152, a vertical height of the compressor 200 may be increased compared to a case where all keys are formed at one side of the body 152.

For reference, when the Oldham's ring in which the key protrudes from one side of the body 152 is used, a size of the fixed scroll 250 may be reduced such that a vertical height of the compressor 200, that is, the size of the compressor 200 may be reduced.

However, as the compression space is reduced due to the reduction in the size of the compressor 200, compression capacity also decreases, which is not suitable for a large scroll compressor having a greater compression capacity, but is suitable only for a small scroll compressor.

However, according to the embodiment of the present disclosure, the scroll compressor 1 may improve the compression capacity by increasing the size of the compressor 200 through the Oldham's ring 150-1 in which the keys 154 and 156 protruding from the both sides of the body 152 are formed compared to the Oldham's ring in which the key protruding from one side of the body is formed in the related art. Further, according to the present disclosure, the scroll compressor 1 may also be applied to the large scroll compressor by improving the compression capacity.

For reference, the reference numerals used in FIGS. 2 to 7 are applied only to the description of the Oldham's ring 150-1 of FIG. 2.

Hereinafter, another example of the Oldham's ring shown in FIG. 1 will be described with reference to FIGS. 8 to 11.

Figure 8:
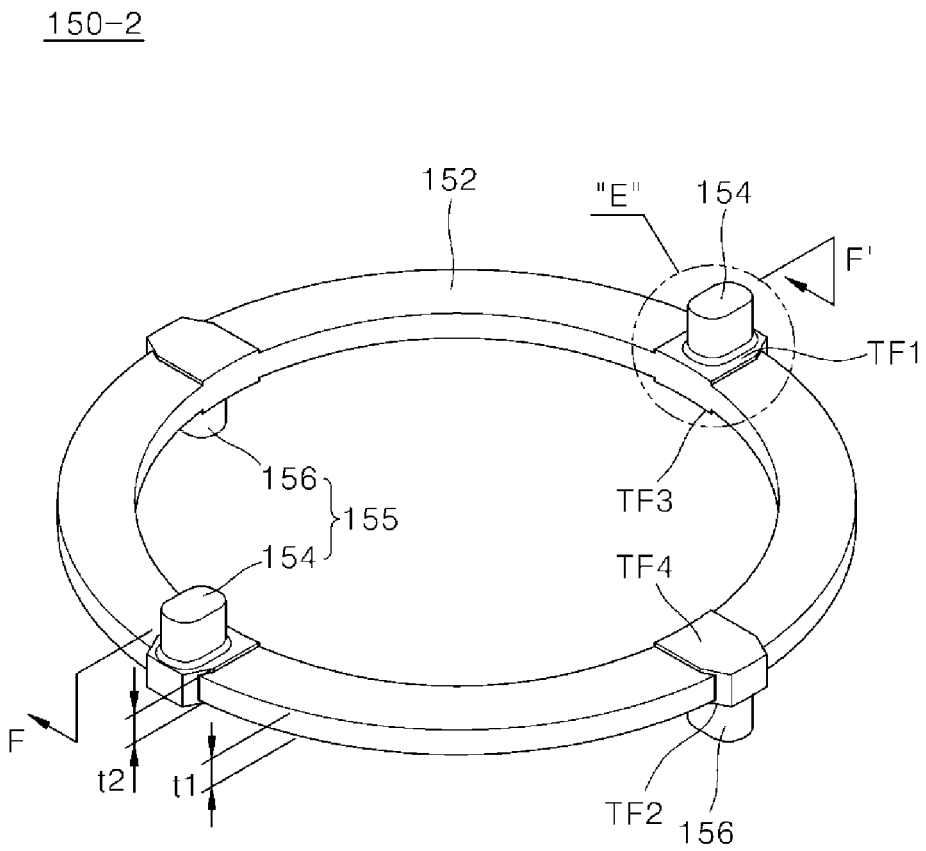
FIG. 8 is a perspective view of another example of the Oldham's ring of FIG. 1.
Figure 9:
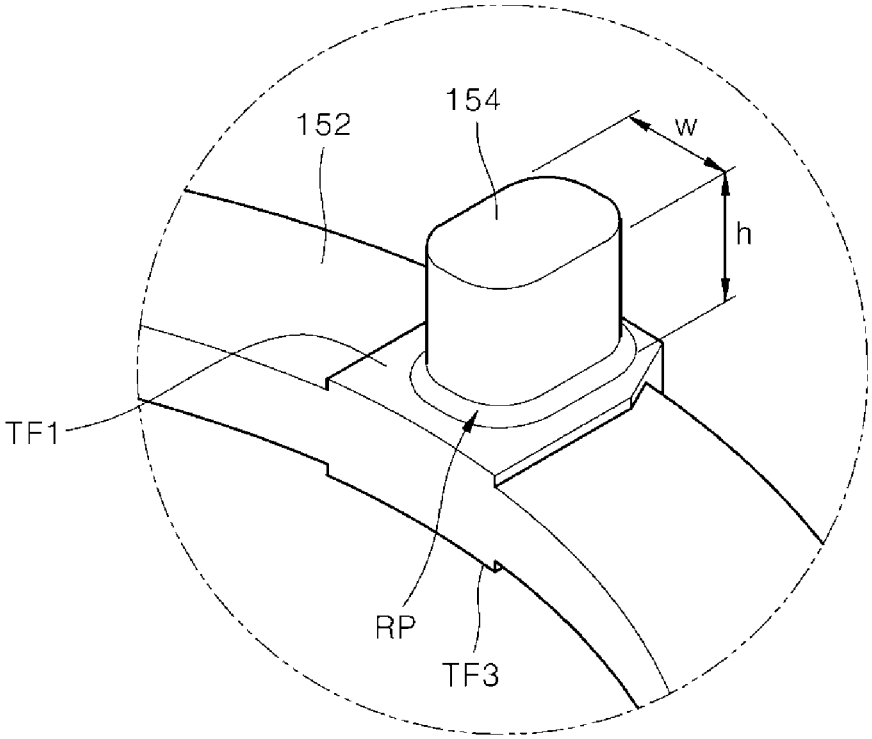
FIG. 9 is an enlarged view of portion E of FIG. 8.
Figure 10:
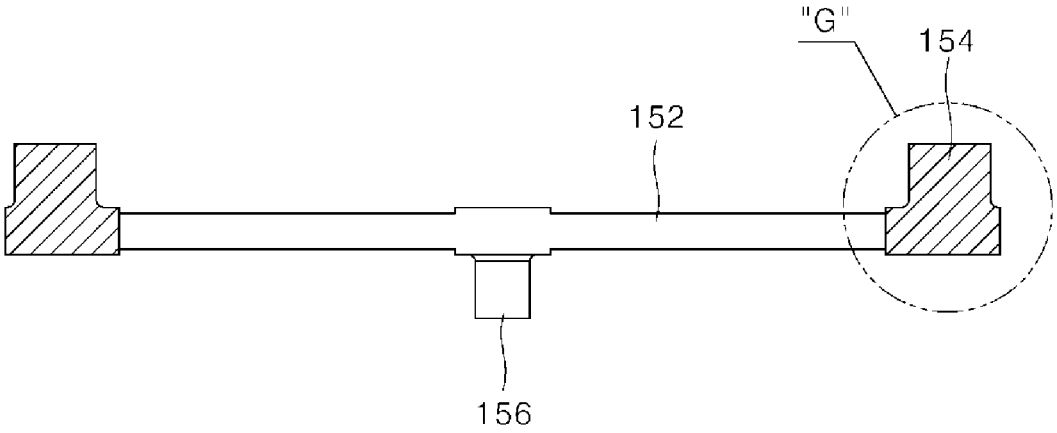
FIG. 10 is a cross-sectional view of the Oldham's ring taken along line F-F' of FIG. 8.
Figure 11:
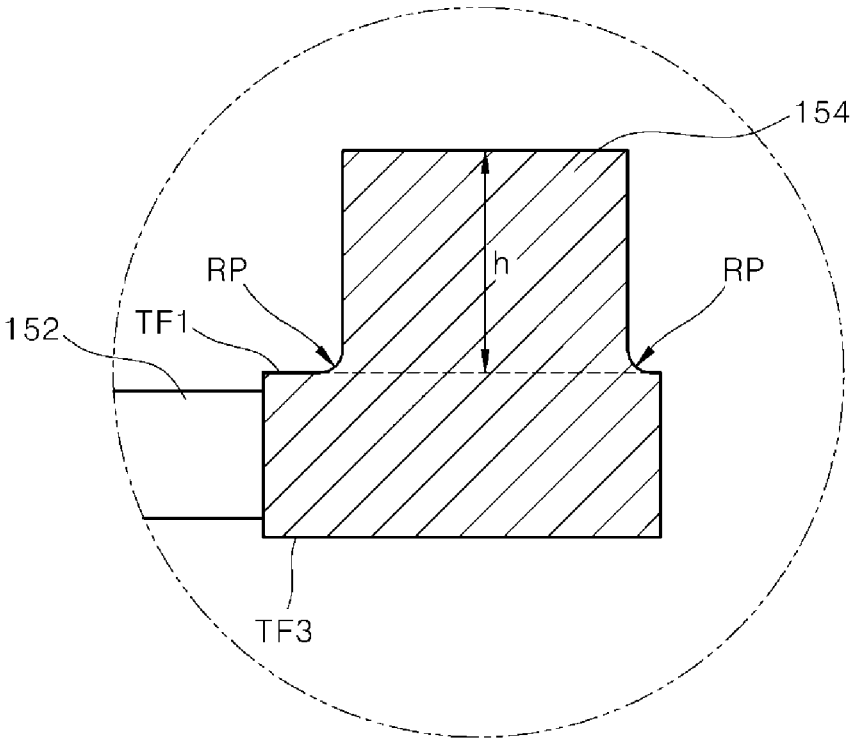
FIG. 11 is an enlarged view of portion G of FIG. 10.

FIG. 8 is a perspective view of another example of the Oldham's ring of FIG. 1. FIG. 9 is an enlarged view of portion E in FIG. 8. FIG. 10 is a cross-sectional view of the Oldham's ring taken along line F-F' of FIG. 8. FIG. 11 is an enlarged view of portion Gin FIG. 10.

Specifically, referring to FIGS. 1 and 8, an Oldham's ring 150-2 may include a body 152 that has a ring shape, a first key 154 that is formed to protrude from one side of a body 152 and is coupled to a main frame 230, and a second key 156 that is formed to protrude from the other side of the body 152 and is coupled to an orbiting scroll 240.

The body 152 has the ring shape, and both axial sides of the body 152 except for the first and second keys 155; 154 and 156 may be formed to have a flat shape.

Of course, as shown in FIG. 8, thrust surfaces (for example, TF1, TF2, TF3, and TF4) may be formed so as to protrude from both axial sides of the body 152 around the key 155 by a predetermined height.

For reference, t1 is a thickness of the body 152, and t2 is a thickness between thrust surfaces at both sides of the body 152, and t2 is greater than t1.

That is, a thrust surface (for example, a first thrust surface TF1) may be formed to be stepped around the first key 154 so as to protrude from one side of the body 152 and a thrust surface (for example, a third thrust surface TF3) may be formed to protrude from the other side of the body 152 that is overlapped with the thrust surface (for example, TF1) in a vertical direction of the body 152 (i.e., an axial direction of the body 152).

A thrust surface (for example, a second thrust surface TF2) may be formed to be stepped around the second key 156 so as to protrude from the other side of the body 152, and a thrust surface (for example, a fourth thrust surface TF4) may be formed so as to protrude from one side of the body 152 that is overlapped with the thrust surface (for example, TF2) in a vertical direction thereof.

For reference, FIG. 8 shows that the thrust surfaces (for example, TF1 to TF4) are formed at both sides of the body 152 around the key 155, but is not limited thereto. That is, the thrust surface may only be formed on one side or the other side of the body 152 around the key 155, other than both sides of the body 152, but in the embodiment of the present disclosure, the thrust surfaces may be formed at both sides of the body 152 around the key 155.

On the other hand, a pair of keys 154 is provided, and the two first keys may be disposed at opposite sides to each other. Further, a pair of second keys 156 is also provided, and the two second keys may be disposed at opposite sides to each other.

For reference, the first key 154 may be arranged in a direction that intersects with the second key 156.

That is, the first keys 154 may be formed at one axial side of the body 152 at an interval of 180 degrees along a circumferential direction of the body 152, and the second keys 156 may be formed at the other axial side of the body 152 at an interval of 180 degrees along a circumferential direction of the body 152.

Accordingly, the two first keys 154 and the two second keys 156 are alternately formed at an interval of 90 degrees along the circumferential direction of the body 152 when viewed from the top.

For reference, although not shown in the drawings, the first and second keys 154 and 156 may be formed in a separate manner from the body 152 and may be coupled to the body 152.

Specifically, for example, a fixing boss (not shown) that has a predetermined height may be formed at a portion of one axial side of the body 152 where the first key 154 is to be coupled, and a fixing groove (not shown) in which the fixing boss is inserted may be formed to not move. The fixing boss may be press-fitted into the fixing grooves or inserted and welded or bonded with an adhesive. In this case, the fixing boss and the fixing groove may have, for example, elliptical, rectangular or angular shapes so that the first key 154 does not rotate incorrectly.

Of course, the fixing boss (not shown) that has a predetermined height may be formed on the other axial side of the body 152 where the second key 156 is to be coupled. A fixing groove (not shown) into which the fixing boss is inserted may be formed so as not to move.

To the contrary, the fixing bosses (not shown) may be formed on the first and second keys 154 and 156, respectively, and a fixing groove may be formed on the body 152.

That is, the key 155 and the body 152 may be coupled to each other in the above-described two manners, and a more detailed description thereof will be omitted.

Meanwhile, the first key 154 may be inserted into a first key groove (not shown) formed in the main frame 230. That is, the main frame 230 may be formed with a first key groove into which the first key 154 is radially slidably inserted, and the first key groove may be formed over, for example, a first end plate 232 and a first side wall 231, but is not limited thereto.

The second key 156 may be inserted into the second key groove (not shown) formed in an orbiting scroll 240. That is, the orbiting scroll 240 may be formed with the second key groove into which the second key 156 is radially slidably inserted, and the second key groove may be formed, for example, at an outer circumference of the third end plate 245, but is not limited thereto.

When the first key 154 is inserted into the first key groove formed in the main frame 230 and the second key 156 is inserted into the second key groove formed in the orbiting scroll 240, the Oldham's ring 150-2 may be arranged to be laterally slidable between the orbiting scroll 240 and the main frame 230.

Meanwhile, a neck (RP of FIG. 9) of the first key 154 may include a lower portion of the first key 154 adjacent to the first thrust surface TF1 and a neck (not shown) of the second key 156 may include a lower portion of the second key 156 adjacent to the second thrust surface TF2.

Further, the neck of each of the first and second keys 154 and 155 may be round-processed (that is, R-processed).

Specifically, referring to FIGS. 9 to 11, the round-processing used for the neck of each of the first and second keys 154 and 155 will be described. For reference, the round-processing is used to the first key 154 and the second key 156 in the same manner, and the first key 154 will be described.

Referring to FIGS. 9 to 11, a level of the round-processing applied to the neck RP of the first key 154 may be set based on a vertical height h of the first key 154 (that is, a height from a first thrust surface TF1 to an upper surface of a first key 154) and a lateral width w of the first key 154. The vertical direction of the first key 154 and the lateral direction of the first key 154 may be orthogonal to each other.

More specifically, the level of the round-processing applied to the neck RP of the first key 154 may be set at a level equal to or greater than the value calculated by (0.5×a vertical height h of the first key 154÷a lateral width of a first key 154).

That is, the level of the round-processing applied to the neck RP of the first key 154 may be set by the following equation.

$R \geq 0.5\ h/w$ ($R$: a level of round-processing, $h$: a vertical height of a first key 154, and $w$: a lateral width of a first key 154) <Equation>

Further, [Table 1] below shows changes in a magnitude of stress applied to the neck RP of the first key 154 in response to a level of round-processing R and a vertical height H of the first key 154 when it is considered that the lateral width of the first key 154 is 8 mm.

TABLE 1

| | R | | | |
|---|---|---|---|---|
| h | 1 | 0.75 | 0.5 | 0.25 |
| 8.5 mm | **60 MPa** | **65 MPa** | 81 MPa | 99 MPa |
| 7.5 mm | **56 MPa** | **59 MPa** | **75 MPa** | 95 MPa |
| 6.5 mm | **52 MPa** | **56 MPa** | **68 MPa** | 88 MPa |

The magnitudes of the stress expressed as bold type in Table 1 described above are the magnitudes obtained when the neck RP of the first key 154 is round-processed based on the above-mentioned <Equation>.

As described above, when the neck RP of the first key 154 is round-processed according to the level of the round-processing set based on the above-mentioned <Equation>, it can be understood that the magnitude of the stress applied to the neck RP of the first key 154 is reduced.

In addition, in the embodiment of the present disclosure, the keys may be formed at both sides of the body 152, and the vertical height of the compressor 200 may be increased compared to the case where all keys are formed at one side of the body 152.

For reference, when the Oldham's ring in which the key protrudes only from one side of the body 152 is used, the size of the fixed scroll 250 may be reduced such that the vertical height of the compressor 200, that is, the size of the compressor 200 may be reduced.

However, as the compression space is reduced due to the reduction in the size of the compressor 200, the compression capacity also decreases, which is not suitable for a large scroll compressor that requires for greater compression capacity but suitable only for a small scroll compressor.

However, as described above, according to the embodiment of the present disclosure, the scroll compressor 1 may improve the compression capacity by increasing the size of the compressor 200 through the Oldham's ring 150-2 in which the keys 154 and 156 protruding from both sides of the body 152 are formed compared to the Oldham's ring in which the key protruding from one side of the body 152 is formed in the related art. Further, according to the present disclosure, the scroll compressor 1 may be applied to the large scroll compressor through the improvement in the compression capacity.

Further, in the embodiment of the present disclosure, the Oldham's ring 150-2 may be made of material different from that of the orbiting scroll 240.

Specifically, the orbiting scroll 240 may be made of, for example, aluminum, and the entire components of the Oldham's ring 150-2 (that is, the body 152 and the key 155) may be made of sintered metal (that is, iron sintered alloy), and the like. When the Oldham's ring 150-2 is made of different material from the material of the orbiting scroll 240, the abrasion of the Oldham's ring may be reduced compared to the case where the Oldham's ring 150-2 is made of the same material as the orbiting scroll 240.

On the other hand, it is possible to provide the Oldham's ring that has the same technical feature as the above-mentioned Oldham's ring 150-2 and a part of which is made of different material from the orbiting scroll. Hereinafter; yet another example of the Oldham's ring shown in FIG. 1 will be described with reference to FIG. 12.

Figure 12:
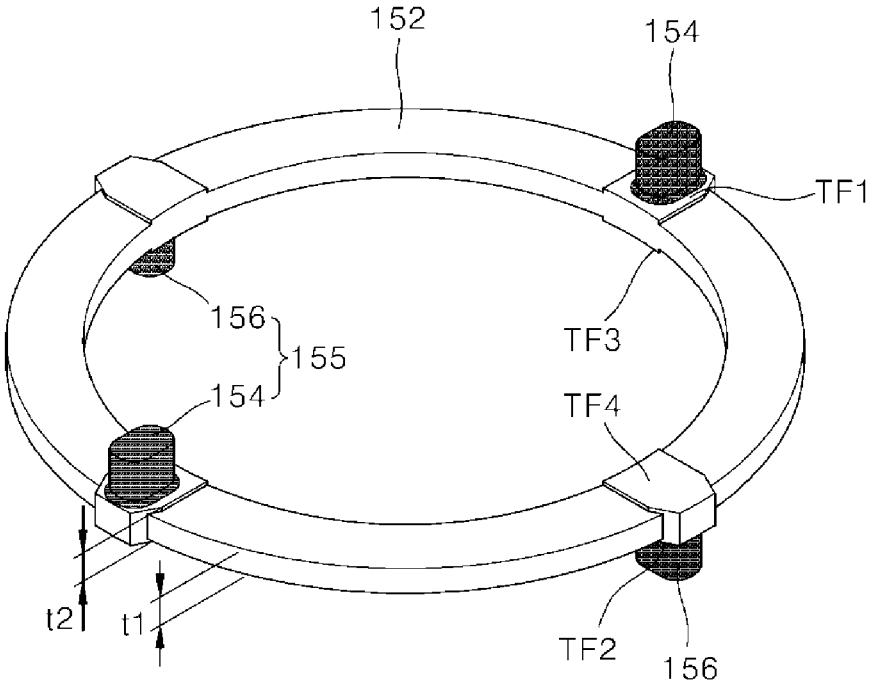
FIG. 12 is a perspective view of yet another example of the Oldham's ring of FIG. 1.

For reference, the Oldham's ring 150-3 shown in FIG. 12 is the same as the Oldham's ring 150-2 shown in FIG. 8 except for the material of the first and second keys 154 and 155, and the difference between the Oldam's ring 150-3 and the Oldham's ring 150-2 will be mainly described.

Referring to FIGS. 1 and 12, in the case of the Oldham's ring 150-3, unlike the Oldham's ring 150-2 shown in FIG. 8, the first and second keys 154 and 155 may be made of different material from the body 152.

Specifically, the body 152 may be made of the same material as the orbiting scroll 240 (for example, aluminum), and the first and second keys 154 and 155 in which the load is substantially applied by the main frame 230 and the orbiting scroll 240 may be made of different material from the orbiting scroll 240, for example, cast iron or iron sintered alloy, and the like.

That is, instead of having the material of the entire components of the Oldham's ring 150-3 different from the material of the orbiting scroll 240, only the first and second keys 154 and 155 are made of materials different from those of the orbiting scroll 240, and it is possible to minimize the increase in the weight of the Oldham's ring 150-3 through the configuration of two kinds of materials and to reduce the degree of the abrasion of the first and second keys 154 and 155 compared to the case where the first and second keys 154 and 155 are made of the same material as the orbiting scroll 240.

For reference, the reference numerals used in FIGS. 8 to 12 are applied only to the description of the Oldham's rings 150-2 and 150-3 shown in FIGS. 8 and 12.

As described above, according to the embodiment of the present disclosure, the scroll compressor 1 enables performing the orbiting movement of the orbiting scroll 240 on the fixed scroll 250 while preventing the orbiting scroll 240 from rotating, thereby improving a compression efficiency of the scroll compressor 1.

According to the embodiment of the present disclosure, the scroll compressor 1 may prevent the detachment of the key 155 from the body 152 and the distortion of the key 155 provided in the Oldham's ring 150-1 to thereby improve coupling force of the key 155 with respect to the body 152. Further, stable orbiting movement is enabled by improving the coupling force of the key 155 with respect to the body 152.

In addition, according to an embodiment of the present disclosure, the scroll compressor 1 may have a stable support point for preventing the detachment of the key 155 from the body 152 and the distortion of the key 155 by improving the shape accuracy of the Oldham's ring 150-1. Furthermore, the reliability of the scroll compressor 1 may be improved by having the stable support point.

In addition, according to the embodiment of the present disclosure, the scroll compressor 1 minimizes the concentration, of the stress, on the neck (e.g., the RP) of the key provided in the Oldham's rings 150-2 and 150-3 to improve the durability and the strength of the neck of the key. Furthermore, the abrasion and the damage of the key may be minimized by improving the durability and the strength of the neck of the key.

According to the embodiment of the present disclosure, the scroll compressor 1 may include all or some of the Oldham's rings 150-1, 150-2, and 150-3 made of materials different from those of the orbiting scroll 240, thereby minimizing the abrasion of the Oldham's rings 150-1, 150-2, and 150-3 due to the contact with the orbiting scroll 240.

Various substitutions, changes, and modifications can be made within a range that does not deviate from the technical idea of the present disclosure for those skilled in the art to which the present disclosure pertain, and the above-mentioned present disclosure is not limited to the above-mentioned embodiments and the accompanying drawings.

What is claimed is:

1. A scroll compressor, comprising:

a drive motor;

a rotary shaft coupled to the drive motor and configured to be rotated by the drive motor;

a main frame that extends along the rotary shaft and that is disposed vertically below the drive motor;

a fixed scroll that extends along the rotary shaft and that is disposed vertically below the main frame;

an orbiting scroll that is disposed between the main frame and the fixed scroll, that receives the rotary shaft, and that is eccentrically coupled to the rotary shaft, the orbiting scroll being configured to, based on engaging with the fixed scroll, perform an orbital movement relative to the fixed scroll to thereby define a compression chamber with the fixed scroll; and an Oldham's ring coupled to each of the main frame and the orbiting scroll and configured to restrict rotation of the orbiting scroll relative to the fixed scroll, wherein the Oldham's ring comprises:

a ring body that has a ring shape, the ring body comprising a first fixing boss that protrudes from a first side of the ring body and a second fixing boss that protrudes from a second side of the ring body, a first key that has a first fixing groove receiving the first fixing boss and that is configured to couple to the main frame, the first key comprising a first thrust surface stepped toward the first side of the ring body, and a second key that has a second fixing groove receiving the second fixing boss and that is configured to couple to the orbiting scroll, the second key comprising a second thrust surface stepped toward the second side of the ring body, and wherein the ring body further comprises:

a first key coupler that is recessed from the first side of the ring body in an axial direction of the rotary shaft and that is coupled to the first key, and a second key coupler that is recessed from the second side of the ring body in the axial direction and that is coupled to the second key.

2. The scroll compressor of claim 1, wherein the first fixing groove extends inside the first key along a radial direction of the ring body, and wherein the second fixing groove extends inside the second key along the radial direction of the ring body.

3. The scroll compressor of claim 1, wherein the first thrust surface is disposed at a lower portion of the first key that faces the first side of the ring body, and wherein the second thrust surface is disposed at an upper portion of the second key that faces the second side of the ring body.

4. The scroll compressor of claim 3, wherein the first thrust surface extends in a direction orthogonal to a side surface of the first key, and wherein the second thrust surface extends in a direction orthogonal to a side surface of the second key.

5. The scroll compressor of claim 1, wherein the orbiting scroll defines a key groove configured to receive the second key, the second key being configured to insert to the key groove in a radial direction of the ring body.

6. The scroll compressor of claim 5, wherein the main frame comprises:

a frame end plate comprising a frame bearing section disposed at a center region of the frame end plate, the rotary shaft passing through the frame end plate; and a frame side wall that protrudes downward from an outer circumference of the frame end plate, wherein the fixed scroll comprises:

a fixed scroll end plate, a fixed wrap that protrudes from an upper surface of the fixed scroll end plate, and a fixed scroll side wall that protrudes upward from an outer circumference of the fixed scroll end plate, and wherein the orbiting scroll comprises:

an orbiting scroll end plate comprising a rotary shaft coupler, the rotary shaft being inserted into and eccentrically coupled to rotary shaft coupler, and an orbiting wrap that protrudes from the orbiting scroll end plate and that is configured to engage with the fixed wrap to thereby define the compression chamber.

7. The scroll compressor of claim 6, wherein the key groove is defined at an outer circumference of the orbiting scroll end plate.

8. The scroll compressor of claim 1, wherein the ring body is made of a first material, and wherein the first key and the second key are made of a second material different from the first material.

9. The scroll compressor of claim 8, wherein the orbiting scroll is made of the first material.

10. The scroll compressor of claim 1, wherein the first key comprises:

an inner surface that defines the first fixing groove and that is in contact with a side surface of the first fixing boss to thereby restrict the first key from rotating relative to the ring body; and an outer surface that is inserted into the first key coupler and in contact with a side surface of the first key coupler to thereby restrict the first key from rotating relative to the ring body.

11. The scroll compressor of claim 1, wherein the second key comprises:

an inner surface that defines the second fixing groove and that is in contact with a side surface of the second fixing boss to thereby restrict the second key from rotating relative to the ring body; and an outer surface that is inserted into the second key coupler and in contact with a side surface of the second key coupler to thereby restrict the second key from rotating relative to the ring body.

12. The scroll compressor of claim 1, wherein the first key comprises:

a lower portion that is inserted into the first key coupler and that is in contact with a bottom surface of the first key coupler and a side surface of the first key coupler; and an upper portion that protrudes above the first side of the ring body and that defines the first thrust surface.

13. The scroll compressor of claim 1, wherein the first key coupler is recessed from the first side of the ring body by a predetermined depth that is less than a height of the first key in the axial direction, and wherein the second key coupler is recessed from the second side of the ring body by a predetermined depth that is less than a height of the second key in the axial direction.

* * * * *